United States Patent [19]

DuRoss et al.

[11] 4,063,631

[45] Dec. 20, 1977

[54] PAPER GUIDE

[75] Inventors: Robert M. DuRoss, Homer; Richard D. Aiken, Killawog, both of N.Y.

[73] Assignee: SCM Corporation, New York, N.Y.

[21] Appl. No.: 749,858

[22] Filed: Dec. 13, 1976

[51] Int. Cl.[2] ..... B41J 13/30

[52] U.S. Cl. ..... 197/142

[58] Field of Search ..... 197/140, 142, 143, 181

[56] References Cited

U.S. PATENT DOCUMENTS

| | | | |
|---|---|---|---|
| 776,017 | 11/1904 | Felbel | 197/181 X |
| 829,989 | 9/1906 | McCormack | 197/140 |
| 890,372 | 6/1908 | Orr | 197/142 |
| 953,571 | 3/1910 | Zimdars | 197/181 |
| 986,515 | 3/1911 | Steele | 197/142 |
| 1,076,013 | 10/1913 | Beaudry | 197/142 |
| 1,311,687 | 7/1919 | Hagerstrom | 197/142 |
| 1,417,903 | 5/1922 | Hess et al. | 197/142 |
| 1,604,785 | 10/1926 | Resch | 197/140 |

*Primary Examiner*—Ernest T. Wright, Jr.

*Attorney, Agent, or Firm*—Kenneth W. Greb; Ernest F. Weinberger; Milton M. Wolson

[57] ABSTRACT

An adjustable paper guide for a typewriter having a paper chute defined by a paper table and an erasure table spaced therefrom. The paper guide includes a sleeve member and a yieldable guide member. The sleeve member includes a guiding surface that extends upward from the top surface of the erasure table and the yieldable guide member includes a guiding surface that extends from the erasure table to engage the paper table. The guiding surfaces guide an edge of a sheet of paper during paper insertion and during paper realignment. The paper table includes a plurality of gripping rollers for feeding paper whereby releasing the contact of the gripping rollers on the paper also releases the paper table. The erasure table is pivotally supported for movement from a closed position to an open position. The yieldable guide member remains engaged with the paper table irrespective of the positions of the paper table and/or erasure table.

14 Claims, 8 Drawing Figures

PAPER GUIDE

BACKGROUND OF THE INVENTION

The present invention relates to typewriters, and more particularly to an adjustable paper guide slidingly supported on the typewriter erasure table. The paper guide includes a sleeve member and a yeildable guide memeber that coact to provide continuous paper guiding during both paper insertion and paper realignment.

The need to guide a sheet or multiple sheets of paper as they are inserted into a typewriter has resulted in various paper guiding devices. All known paper guiding devices for typewriters as disclosed in the prior art teach single surface paper guides slideably supported on the paper table. The paper table provides a chute on which a sheet of paper is placed for controlled insertion into the typewriter and the paper guide thereon provides the lateral guide for an edge of the paper.

One example of such a paper guide is disclosed in U.S. Pat. No. 1,417,903 to E. B. Hess et al. This patent teaches an adjustable recessed scale plate that cooperates with a slideable paper guide. Both scale plate and paper guide are supported on the paper table for lateral movement relative thereto. The paper guide extends upward from the paper table and spans a portion of the distance to the printing platen.

Another example of an adjustable paper guide is disclosed in U.S. Pat. No. 1,311,687 granted to J. A. Hagerstrom. This patent teaches dual slideable paper guides supported on an auxiliary table that is disposed below the the paper table. The guides are slideable along the length of the auxiliary table and include an upward extending combination finger grip and paper guide that partially spans the distance between the auxiliary table and the platen.

In this and all other known prior art, the paper chute is not completely closed making it possible for the inserted paper to bypass the guide and result in misalignment of the paper during insertion.

The present inventive concept teaches complete guide control of the paper during insertion into the typewriter by spanning the paper chute thereby preventing the paper from bypassing the guide eliminating any unnecessary realignment of the paper.

Prior art paper guiding devices generally include portions which project into the path of the paper and require additional structures to prevent paper jams caused by such projections. The instant invention precludes the need for any additional structures.

SUMMARY OF THE INVENTION

The present invention is an adjustable paper guide for a typewriter having a platen, a releasable paper table and a pivotal erasure table spaced from the paper table. The paper guide includes a sleeve member having a flexible tubular portion frictionally and slidingly engaging the erasure table for support of the paper guide thereon.

The paper guide includes an abutment carried by the sleeve that projects upward from the erasure table, and a yieldable guide member that extends to engage the paper table, and cooperates with the upstanding abutment to provide a complete guide for any papers that are inserted into the typewriter. The yieldable guide member includes a guiding surface disposed between the erasure table and the paper table and substantially spans the distance therebetween. The upstanding abutment includes a guiding surface perpendicular to a lower face which is in slideable contact with the top surface of the erasure table. The guiding surface on the yieldable guide member and the guiding surface on the abutment are in planar alignment for unrestricted guiding of the paper. A yieldable finger connects the yieldable guide member to a wall of the sleeve so as to bias the yieldable guide member toward the paper table and into engagement therewith irrespective of the positions of the paper and/or erasure tbles.

Accordingly, it is an object of the present invention to provide a readily adjustable paper guide for typewriters that is structurally yieldable, that spans the area between the erasure table and the paper table and that continually engages the paper table.

A further object of the present invention is to provide a simple, reliable and low cost paper guide for a typewriter.

Other objects, features, and advantages of the invention will become more apparent from the following description, including appended claims and accompanying drawing.

DESCRIPTION OF THE PREFERRED EMBODIMENT

Figure 1:
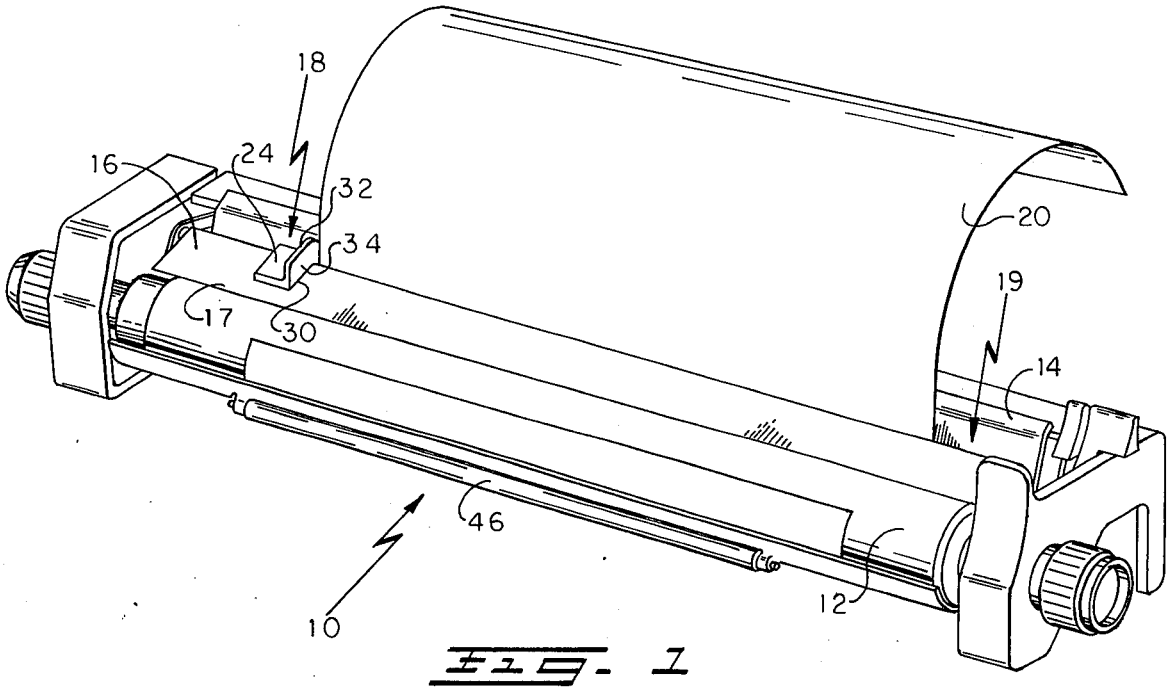
FIG. 1 is a perspective view of a portion of a typewriter incorporating the paper guide made in accordance with the invention.
Figure 2:
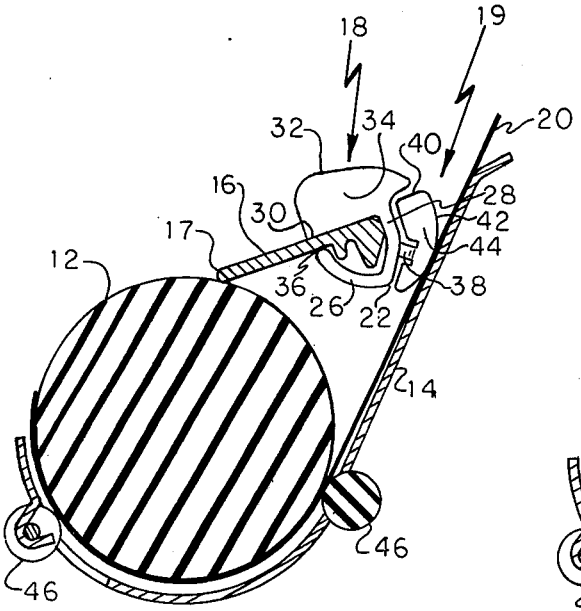
FIG. 2 is a side elevation view showing the paper guide in relation to the paper table while in its operative position.

In the illustrated embodiment of FIG. 1, a typewriter carriage 10 supports a printing platen 12, a paper table 14 and an erasure table 16 in parallel relation, as is well known. As is conventional, the erasure table 16 is pivotally supported and spring biased to a closed position whereby a front portion 17 rests on the platen 12. Slideably supported on the erasure table 16 is a paper guide 18. As shown in FIG. 2, the paper table 14 is spaced apart from the erasure table 16 defining a paper chute 19 into which a sheet of paper 20 is inserted.

Figure 4:
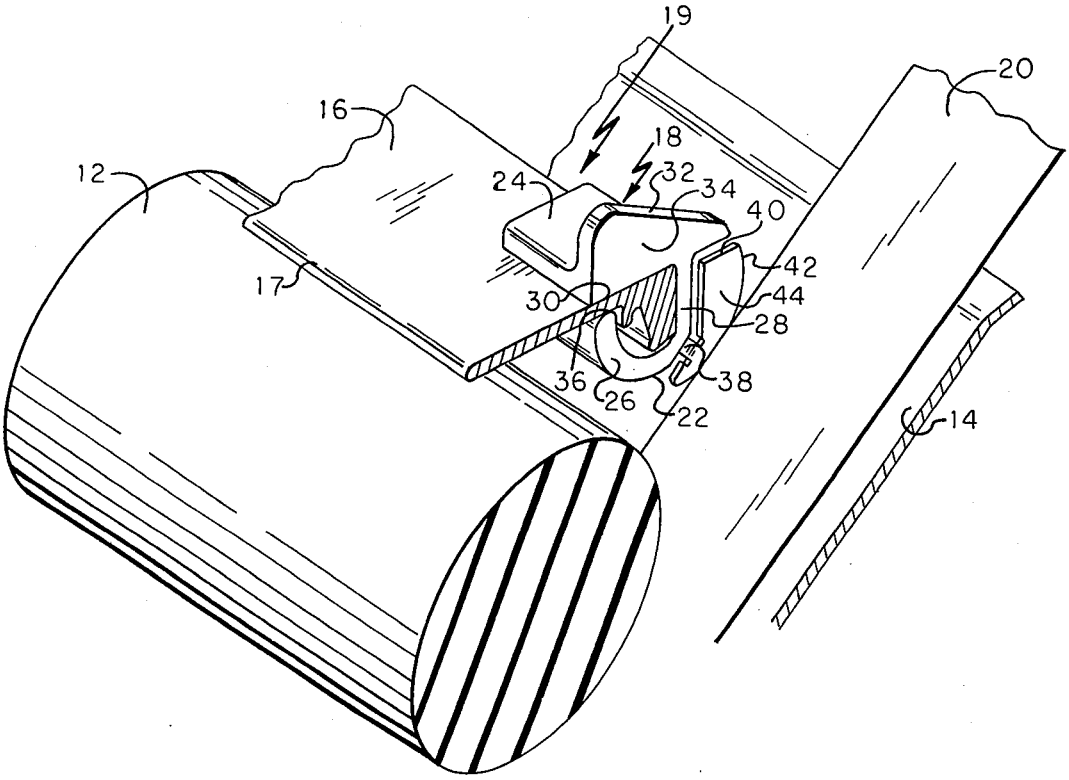
FIG. 4 is an enlarged front perspective view of a portion of the typewriter illustrating the paper guide made in accordance with the invention.

Referring to FIG. 4, the paper guide 18 includes an open sleeve member 22 having an extending stabilizer portion 24 and a flexible tubular portion 26 connected to a wall 28. The stabilizer portion 24 includes a lower face 30 and an abutment 32 that projects upward from one end to form a guiding surface 34 for an edge of the sheet of paper 20. The stabilizer portion 24 extends in a direction opposite that of the guiding surface 34 with the lower face 30 resting on the erasure table 16 for stabilizing the attitude of the abutment 32. A free upper edge 36 of the tubular portion 26 terminates proximate but spaced from the lower face 30. The space therebetween is selected such that when the guide 18 is positioned on the erasure table 16, the edge 36 frictionally engages the erasure table 16 for selective sliding movement therealong.

Figure 5:
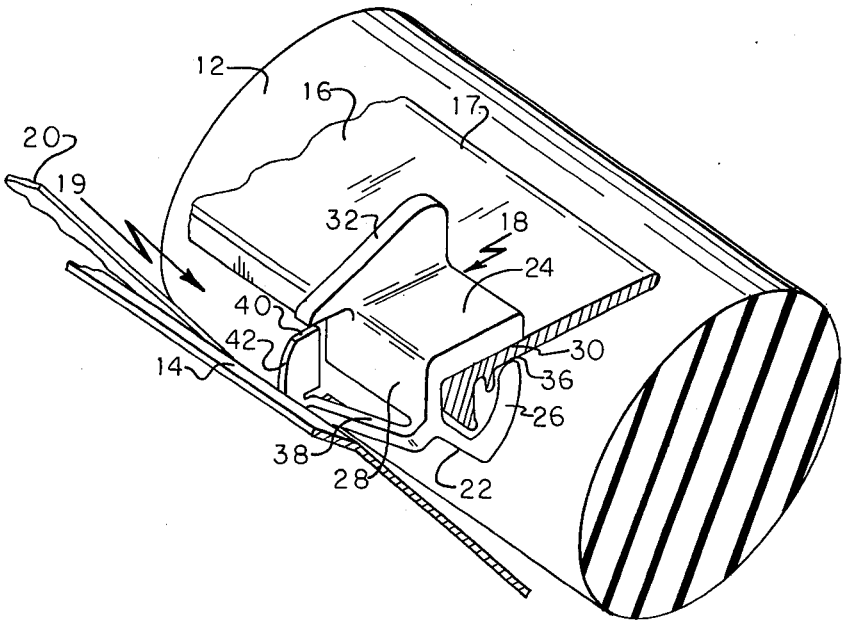
FIG. 5 is an enlarged rear perspective view of the paper guide of FIG. 4.

A yieldable spring like finger 38 integrally connected to the wall 28 extends divergingly from an end of the sleeve member 22 opposite the guiding surface 34 to provide a support for a guide member 40, as best shown in FIG. 5. The guide member 40 includes an arcuate edge 42 and a planar guiding surface 44 for guiding the edge of the sheet of paper 20. The guiding surface 44 is in planar alignment with the guiding surface 34 of the sleeve member 22 and substantially spans the paper chute 19. The guide member 40 is normally biased outwardly by virtue of structural angular relationship of the connecting yieldable finger 38 with the sleeve member 22. The dimensions of the finger 38 and the guide member 40 are selected so that when the paper guide 18 is positioned on the erasure table 16, the edge 42 is always biased into contact with the paper table 14.

Figure 3:
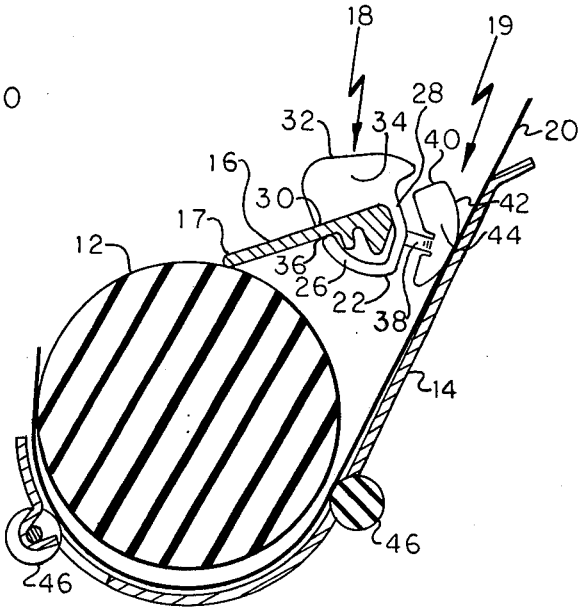
FIG. 3 is a side elevation as shown in FIG. 2 with the paper table in its inoperative position permitting paper alignment.
Figure 6:
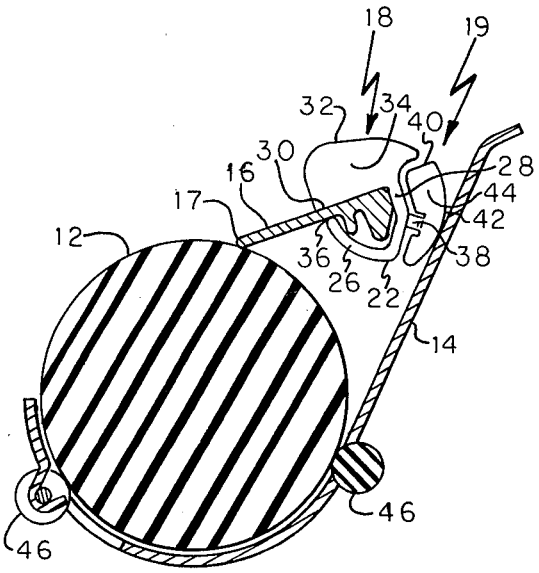
FIG. 6 is a side elevation view showing the paper guide with the erasure table and paper table in their closed operative positions prior to paper insertion.

In operation, paper table 14 is disposed in a substantially rigid manner parallel with the carriage platen 12. A plurality of rotatable paper feed rollers 46 are in gripping contact with the platen 12, as shown in FIG. 6. The paper guide 18 is manually positioned along the length of the erasure table 16 preferably by gripping the upstanding abutment 32 and laterally repositioning it to a selected left hand margin. When the paper 20 is inserted into the paper chute 19, its edge is guided by the surface 44 of the guide member 40 and/or by the guiding surface 34 of the sleeve member 22. Thereafter, as shown in FIG. 2, paper 20 is gripped between the paper feed rollers 46 and the platen 12 as it is fed in an arcuate path around the platen 12 to a typewriter printing station. The lateral positioning of paper 20 is determined by the pre-set selection position of the paper guide 18 on the erasure table 16. As shown in FIG. 3, to realign paper 20 after it is in the typewriter, the grip of the paper feed rollers 46 must be released to permit free movement of the paper 20. This is accomplished by repositioning the roller supporting paper table 14 away from the platen 12 thereby opening the paper chute 19. When the paper table 14 is in the open position, the feed rollers 46 are no longer in gripping contact with the platen 12, as shown in FIG. 3, and paper 20 is therafter universally repositionable. In order to prevent paper misalignment when the paper table 14 is in its open position, the finger 38 must carry the guide member 40 such that yielding contact is maintained with the paper table 14 by the guide member 40. The guide member 40 is supported on the finger 38 and is therefore structurally yeildable as the paper table 14 is repositioned. The guiding surface 34 of the sleeve member 22 and the guiding surface 44 of the guide member 40 remain substantially in planar alignment when the paper table 14 is in the open position allowing the edge of paper 20 to be positioned on one or both guiding surfaces 34 and 44.

Figure 7:
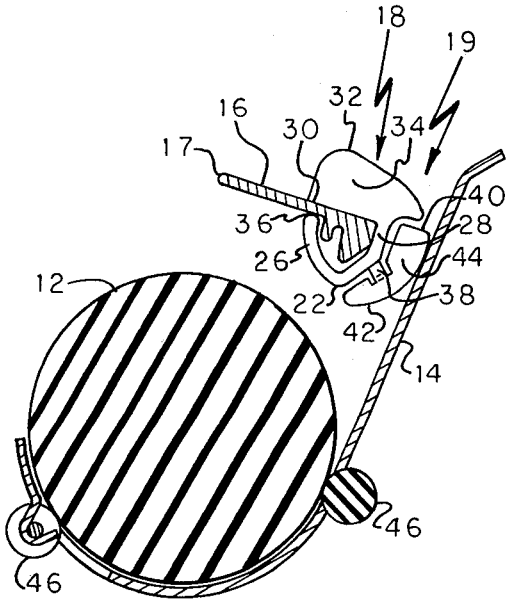
FIG. 7 is a side elevation view as shown in FIG. 6 showing the erasure table pivoted to an open position.

The erasure table 16 is pivotable to an open position such that its front portion 17 is spaced from the platen 12, as shown in FIG. 7. The arcuate edge 42 of the guide member 40 is arcuately structured whereby some portion thereof always remains abuttingly engaged with the paper table 14 when the erasure table 16 is in the open position.

Figure 8:
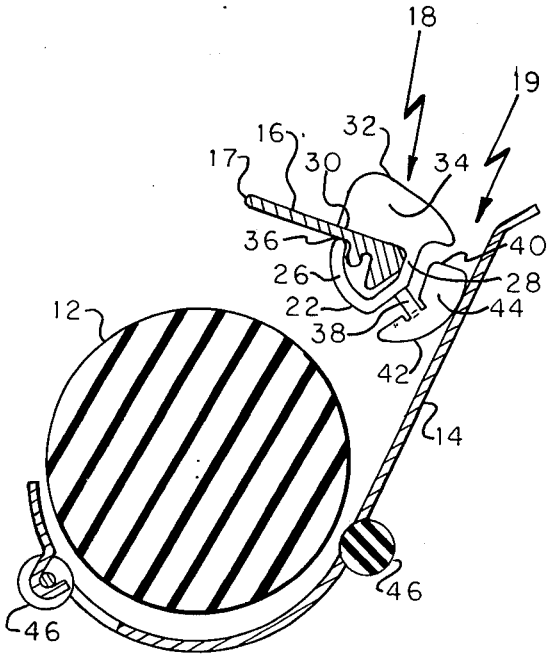
FIG. 8 is a side elevation view as shown in FIG. 7 showing the paper table in its inoperative position.

FIG. 8 shows the erasure table 16 and the paper table 14 simultaneously spaced to their open positions. Under these conditions the biasing action of finger 38 forces another portion of edge 42 to abut the paper table 14. The guiding surface 34 of the sleeve member 22 and the guiding surface 44 of the guide member 40 remain substantially in planar alignment.

It can therefore be seen from the foregoing that a sheet of paper 20 may be inserted and accurately guided into a typewriter adapted with the instant paper guide 18 and after insertion realigned with the paper chute 19 always closed.

While the foregoing description has shown and described the fundamental novel features as applied to a preferred embodiment, it will be understood by those skilled in the art that modifications embodied in various forms may be made without departing from the spirit and scope of the invention.

What is claimed is:

1. A paper guide for a typewriter to selectively guide a sheet of paper, the typewriter having a two position paper table and an erasure table spaced from the paper table to define a paper chute and a platen for supporting the sheet of paper for printing thereon, the paper guide comprising:

a sleeve member supported on the erasure table for yieldable sliding frictional cooperation therewith; and a yieldable guide member carried by said sleeve member abuts against the paper table when located in either of the two positions, said yieldable guide member includes a guiding surface substantially spanning the paper chute with the paper table located in either of the two positions for guiding an edge of the sheet of paper when inserting the sheet of paper into the paper chute.

2. A paper guide as defined in claim 1 including means for biasing said yieldable guide member into abutting relation with the paper table.

3. A paper guide as defined in claim 2 wherein said biasing means is a yieldable finger integrally connected to said sleeve member and to said yieldable guide member.

4. A paper guide as defined in claim 1 wherein said yieldable guide member is integrally connected to said sleeve member by a yieldable finger at an end opposite from said guiding surface.

5. A paper guide as defined in claim 1 wherein said sleeve member includes a flexible tubular portion abutting the erasure table to frictionally engage the sleeve member with the erasure table.

6. A paper guide as defined in claim 1 wherein said sleeve member includes an upstanding abutment for manually adjusting said sleeve member along the erasure table.

7. A paper guide as defined in claim 6 wherein said abutment includes a guiding surface for guiding the edge of the sheet of paper.

8. A paper guide as defined in claim 1 wherein said sleeve member includes a guiding surface in planar alignment with said guiding surface of said yieldable guide member for guiding the edge of the sheet of paper.

9. A paper guide as defined in claim 7 wherein said sleeve member includes a stabilizer portion extending along the surface of the erasure table for stabilizing the attitude of said abutment.

10. A paper guide as defined in claim 9 wherein said stabilizer portion extends in a direction opposite from said guiding surface.

11. A paper guide as defined in claim 1 wherein the two position paper table includes an open position spaced from the platen, said sleeve member includes a guiding surface for guiding the edge of the sheet of paper when inserting the sheet of paper into the paper chute, and said guiding surface of said yieldable guide member is substantially in planar alignment with said guiding surface of said sleeve member when the paper table is in the open position.

12. A paper guide as defined in claim 1 wherein the erasure table is pivtable to an open position spaced from the platen and said yieldable guide member remains engaged with the paper table when the erasure table is in said open position.

13. A paper guide as defined in claim 1 wherein the two position paper table includes an open position spaced from the platen, the erasure table is pivotable to an open position spaced from the platen, and said yieldable guide member remains abutting against the paper table when the paper table is in said open position and when the erasure table is in said open position.

14. A paper table as defined in claim 13, wherein said sleeve member includes a guiding surface for guiding the edge of the sheet of paper when inserting the sheet of paper into the paper chute, and said guiding surface of said yieldable guide member is substantially in planar alignment with said guiding surface of said sleeve member when the paper table is in said open position and when the erasure table is in said open position.

* * * * *